US006028597A

United States Patent [19]

Ryan, Jr. et al.

[11] Patent Number: 6,028,597

[45] Date of Patent: Feb. 22, 2000

[54] POWER MANAGER SYSTEM FOR HIGHWAY SIGNAGE

[75] Inventors: Patrick Henry Ryan, Jr.; Stephen P. Hart, both of Atlanta, Ga.

[73] Assignee: American Signal Company, Atlanta, Ga.

[21] Appl. No.: 08/591,781

[22] Filed: Jan. 25, 1996

[51] Int. Cl.[7] ..... G09G 5/00

[52] U.S. Cl. ..... 345/211; 345/148; 345/82

[58] Field of Search ..... 345/211, 212, 345/204, 207, 214, 147, 148, 82, 44, 46, 63; 315/86, 149, 307

[56] References Cited

U.S. PATENT DOCUMENTS

| | | | |
|---|---|---|---|
| 3,651,511 | 3/1972 | Andrews et al. | 340/324 R |
| 4,484,104 | 11/1984 | O'Brien | 315/86 |
| 4,514,727 | 4/1985 | Van Antwerp | 345/148 |
| 4,668,120 | 5/1987 | Roberts | 404/12 |
| 4,682,147 | 7/1987 | Bowman | 340/286 R |
| 4,691,118 | 9/1987 | Nishimura | 307/66 |
| 4,736,186 | 4/1988 | Jones | 340/331 |
| 4,841,278 | 6/1989 | Tezuka et al. | 340/908.1 |
| 4,963,811 | 10/1990 | Weber | 310/1 |
| 4,988,889 | 1/1991 | Oughton, Jr. | 307/66 |
| 5,012,160 | 4/1991 | Dunn Thompson et al. | 315/149 |
| 5,027,258 | 6/1991 | Schoniger et al. | 362/31 |
| 5,138,534 | 8/1992 | Wu | 362/72 |
| 5,152,601 | 10/1992 | Ferng | 362/183 |
| 5,175,528 | 12/1992 | Choi et al. | 340/331 |
| 5,211,470 | 5/1993 | Frost et al. | 362/183 |
| 5,214,352 | 5/1993 | Love | 315/86 |
| 5,237,490 | 8/1993 | Ferng | 362/183 |
| 5,252,893 | 10/1993 | Chacham et al. | 315/200 A |
| 5,309,656 | 5/1994 | Montgomery | 40/442 |
| 5,313,187 | 5/1994 | Choi et al. | 340/331 |
| 5,313,188 | 5/1994 | Choi et al. | 340/331 |
| 5,365,145 | 11/1994 | Fields | 315/86 |
| 5,367,442 | 11/1994 | Frost et al. | 362/183 |
| 5,453,729 | 9/1995 | Chu | 340/332 |
| 5,457,450 | 10/1995 | Deese et al. | 340/912 |

*Primary Examiner*—Xiao Wu

*Attorney, Agent, or Firm*—Bernstein & Associates, P.C.

[57] ABSTRACT

A power management system for the control and operation of distributed power has a controller operatively connected to a plurality of monitors, switches, control devices, and a visible light emitting array. The monitors, switches, and control devices provide the means for the controller to modulate the power to the visible light emitting array using a current modulator. The current modulator produces a variable power duty cycle that is received by the visible light emitting array. The visible light emitters of that array have a selected perceivable brightness. That brightness is held constant but power is conserved due to the controller modulating the power.

5 Claims, 3 Drawing Sheets

POWER MANAGER SYSTEM FOR HIGHWAY SIGNAGE

FIELD OF THE INVENTION

The invention relates generally to a power management system of graphic displays for signage. In particular the invention is directed to a power management system with multiple arrays of characters and multiple graphic display elements for signage. The invention is more particularly directed to a power management system for individual light emitting cells within each array.

BACKGROUND OF THE ART

Power management for signage may take many forms in providing effective power control for illumination. Visible light from emitters typically will impinge on the surface of a reflective sign surface and then be radiated outwardly to perspective viewers of the signage. In the early stages of the development of highway signage, visible light emitters comprised a matrix of incandescent light bulbs, and the highway signage was controlled by electromechanical controllers. Those electromechanical controllers typically employed mechanical relays and switches to implement the various functions of the controller.

The use of solar energy as a power source for illumination of highway signage is more recent in the art field. A solar power source typically comprises a plurality of photovoltaic cells, operatively connected, to produce a voltage and transmit an electrical current. The solar power source combined with a rechargeable battery or batteries provide the power for a visible light emitting array both in day light and during night time. When the output voltage of the solar power source drops below a certain level after sunset, the battery or batteries will discharge providing power to the visible light emitters. When the output voltage of the photovoltaic solar cells increases above a certain level after sunrise, battery voltage discharge stops and the output of the photovoltaic solar cells charges the batteries. The solar cells typically provide power to the visible light emitters of the highway signage during day light periods.

Highway signage display apparatus such as traffic markers, delineators, and other safety devices may be used to delineate highway traffic lanes, pillars, posts, barricades, support columns, entry and exit ramps, and crash cushion bars only to name a few. These display apparatus typically use one set of display elements during daytime lighting conditions, usually flip-disks or other passive elements with light reflecting or fluorescent surfaces. Another set is used during night time lighting conditions and they are generally light emitting diodes (LEDs) or other active elements with light emitting capability. These display apparatus may also be use in conjunction with one another during the daylight hours to provide enhances readability of the highway signage.

DESCRIPTION OF THE PRIOR ART

Power management of a light emitting array comprising a multiplicity of visible light emitters presents a power and control network problem of great breadth. There have been many attempts of controlling power such as U.S. Pat. No. 3,651,511 to Andrews. Andrews discloses a traveling message display that normally comprises an array of visible light emitters controlled by an electromechanical relay. Andrew controls power by pulsing that array at a high rate. That high rate or "on", "off" cycle of the array is perceived as undetectable by a viewer. This particular method of power control only modulates brightness. It does not compensate for decreasing battery voltage; therefore, it cannot effectively control power.

U.S. Pat. No. 4,384,317 to Stackpole discloses a solar power lighting system comprising a photovoltaic solar array connected to a rechargeable battery and that battery is connected to a visible light emitting array. Stackpole controls power by providing a power regulator in series with the battery and the photovoltaic solar array. When ambient lighting conditions are at their peak the array produces enough power to charge the batteries and power the visible light array. The power control is clamped at an artificially high level; therefore, as the ambient light conditions change the regulator turns off thereby powering the visible light array solely on the power of the battery. Stackpole does not disclose any apparatus or method of controlling power by modulating the power distributed across a visible light emitting array.

U.S. Pat. No. 4,668,120 to Roberts discloses a self contained photovoltaic solar power reflector for highway signage. Roberts controls power by pulsating the reflector at a selected rate. That selected rate indeed controls power but without concern for variations of ambient lighting conditions or battery voltage .

U.S. Pat. No. 4,841,278 to Tezuka discloses a solar powered visible light emitting array comprising a plurality of LEDs and connecting circuitry that pulses the array to produce varying rates of illumination. When the voltage generated from an attached photovoltaic solar power array decreases because of decreasing ambient light conditions, the light emitting array turns on. This particular method only varies the flash rate of the array. It is well known in the art that varying the flash rate of the light emitting array, as a result of decreasing ambient light conditions, does nothing to maintain constant brightness of the light emitting array. Constant brightness under these conditions requires adjustments be made to the power supplied to the light emitting array along with varying the flash rate of the light emitting array. Maintaining constant brightness while varying the flash rate of the light emitting array is not disclosed by Tezuka.

U.S. Pat. Nos. 5,175,528-5,313,188-5,313,187 all to Choi et al disclose one or more light emitting diodes (LEDs) having a variable pulse duty cycle. This duty cycle is manually controlled by a three position switch that provides the user with an "off", "steady on", and a "flash" position. This type of control allows the user to vary the brightness of the LEDs but does not maintain constant brightness under varying ambient light conditions. Choi et al suffers from the same dilemma as others. Maintaining constant brightness while conserving power are, until the present invention, incongruent factors. That is, constant brightness expends power; therefore, stored power decreases under decreasing ambient light conditions. The converse is also true. Conserving power under decreasing ambient light conditions sacrifices constant brightness.

Accordingly there is a need for a method and apparatus to maintain constant brightness of visible light emitters while conserving power.

SUMMARY OF THE INVENTION

The present invention provides a power management system for the control and operation of distributed power. In a preferred embodiment a controller is provided for implementing the present invention. The controller commands and controls an electrical energy source that provides power to visible light emitters. Those visible light emitters preferably are clustered in an array or cell but may, if desired, be a single visible light emitter. The electrical power is received by the visible light emitters from a photovoltaic solar array wherein the electrical power is transformed into visible light at a selected constant brightness or constant illumination.

The selected illumination is determined from a multiplicity of parameters selected from but not limited to: ambient light conditions; level of charge remaining on provided rechargeable batteries; availability of alternate power sources; available power from a photovoltaic solar power array; expected range of day light to dark time period; determination of cloud cover or long periods of solar absence, and control of the selective positioning of the solar array to track solar intensity impinging on the surface of the photovoltaic solar array during day light periods. The selected illumination parameters or data are processed by the controller.

The controller has a central processor module, a memory module, and a plurality of input and output devices to send and receive data to and from a plurality of sensors and monitors. The controller produces a modulated control signal from selected illumination data that allows a selected constant brightness or illumination while maximizing the power efficiency of the system. The controller then transmits that modulated signal to a visible light control module or device that is operatively connected to the visible light emitters.

The visible light control module, has a bias control device capable of transforming a signal changing in amplitude, duration, and repetition to a signal for controlling the power provided to the visible light emitters. The bias control output may, if desired, be in phase or out of phase with the bias control input. An example of a visible light control module that may, if desired, be used in the present invention comprises an open collector power transistor having the collector as the output of the module; and its base capable of receiving control signals from the controller. The visible light emitters are operatively disposed in the power transistor's collector base circuit and the control signal is applied to the base emitter circuit of the power transistor. The effect of the bias control device on the visible light emitters is that current to the visible light emitters is modulated. Modulating that current produces an average power delivered to the light emitting array. The light emitting array receives that average power and transforms it into a constant perceived brightness of the visible light emitters.

Accordingly an object of the present invention is power management of a visible light emitting array. Another object of the present invention is maintaining a selected constant brightness while power is conserved. Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
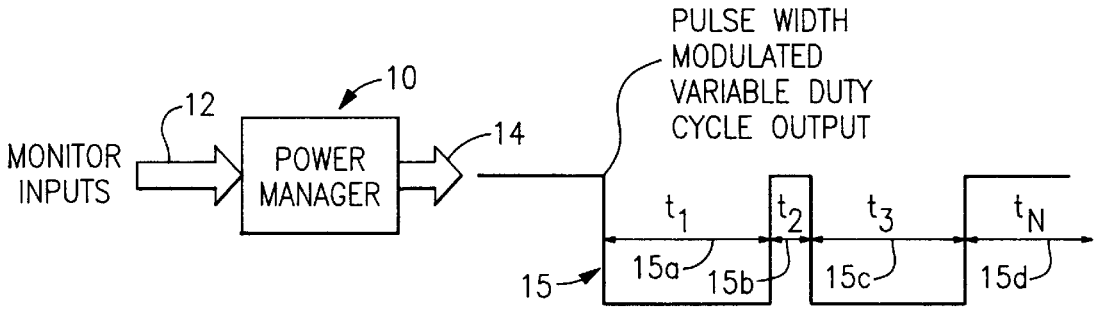
FIG. 1 illustrates a block diagram of a power manager system.

A power manager system is generally illustrated at 10 of FIG. 1 of the drawings. Power manager 10 receives a plurality of monitored inputs 12 and processes those monitored inputs to produce a pulse width modulated, variable duty cycle output signal 14. Modulated output signal 14 may, if desired, be of any amplitude, frequency, phase, or power level. An example of modulated output signal 14 is illustrated at 15. This example is for illustration purposes only. The pulse width modulated variable duty cycle output signal 15 may, if desired, be of any selected time period, duration, power level, and have any phase relation to monitored signal 12. Signal 15 illustrates three distinctive time periods $t_1$, $t_2$, $t_3$ illustrated at 15*a,* 15*b,* and 15*c.* These time periods represent a distinctive requirement from the processed monitored inputs 12. Time period 15*a* may, if desired, be equal to or different from time period 15*b* and 15*c.* Signal 15 may, if desired, be a plurality of individually selected time periods with each time period representing a particular requirement of power manager 10. The plurality of individually selected time periods, $t_n$, is illustrated at 15*d.* Time period 15*d,* like time period 14 may, if desired, be of any period, phase, amplitude, or frequency.

Figure 2:
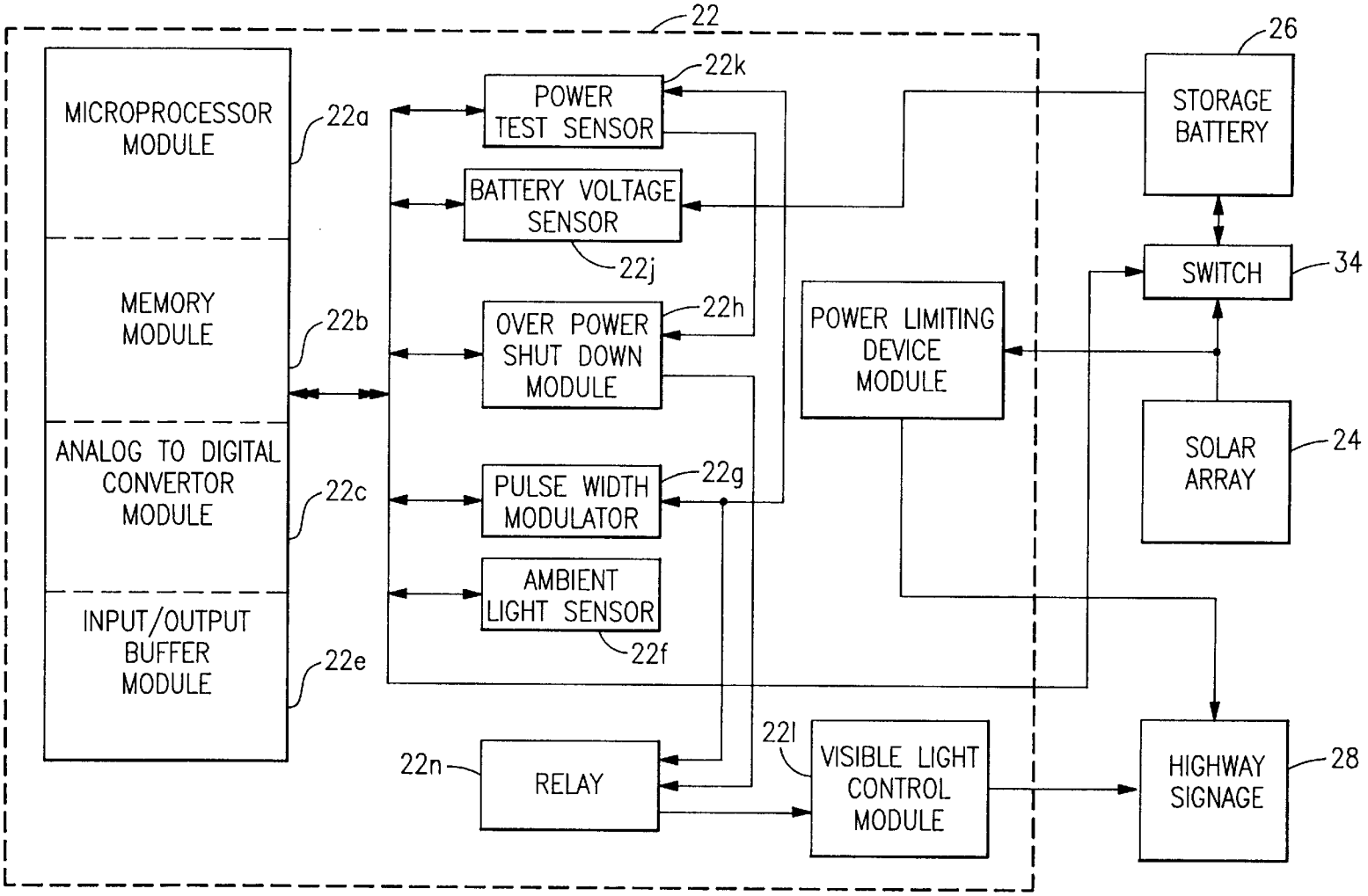
FIG. 2 illustrates a block diagram of a controller for implementing the power manager system of FIG. 1.

Power manager 10 utilizes an interactive controller 22, FIG. 2, for receiving, processing, and transmitting commands and controls to and from a highway signage 28. Interactive controller 22 has a microprocessor module 22*a,* a memory module 22*b,* an analog to digital converter module 22*c,* and an input/output buffer module 22*e.* All of which are interactively connected in any convenient manner to facilitate the operation of controller 22. Controller 22 further comprises an a power test sensor 22*k,* a battery voltage sensor 22*j,* over power shut down module 22*h,* a pulse width modulator 22*g,* an ambient light sensor 22*f,* a relay 22*n,* a visible light control module 22*l* and a power limiting device module 22*m.*

A predetermined program may be stored in memory module 22*b* providing microprocessor module 22*a* with instructions for the operation of power manager 10. The actual coding of the predetermined program is well known in the art field and can be accomplished by any one of ordinary skill in the art field.

Analog to digital converter module 22*c* receives inputs from the aforementioned sensors through input/output buffer module 22*e.* Analog to digital converter module 22*c* transmits those sensor signals to microprocessor module 22*a* for processing. Communication to those aforementioned modules from microprocessor module 22*a* is through input/output buffer module 22*e.* That communication may, if desired, take the form of pulses or steady state signals to activate or deactivate any or all sensors of controller 22.

Battery voltage sensor 22*j* is operatively connected to a rechargeable storage battery 26. Battery voltage sensor 22*j* transmits a monitored voltage to microprocessor module 22*a* for processing. That monitored voltage represents not only the voltage level of the battery but also charging voltage level provided by solar array 24.

The photovoltaic cells are clustered or connected together to provide a combined selected loaded voltage output in the range of 11 VDC to 17 VDC. This combined voltage has sufficient potential to be applied across a single or multiple rechargeable storage batteries thereby recharging the battery or batteries if necessary.

Controller 22 determines if storage battery 26 has sufficiently charged to a selected level. Controller 22 may now require a bypass switch 34 to be activated thereby bypassing storage battery 26 and applying the power generated by solar array 24 to highway signage 28. Controller 22 will compensate for any changes in the voltage applied to highway signage 28 by changing the duty cycle of visible light control module 22*l*. This preventive measure by the present invention maintains and extends the useful life of the storage battery 26. Switch 34 as a matter of convenience may, if desired, be positioned within controller 22 or as illustrate in FIG. 2 be position outside of controller 22. In either case switch 34 functions to bypass battery 26 at the command of controller 22.

Power test sensor 22*k* has a test visible light emitter operatively disposed within (not shown) and that visible light emitter may be the same type or comparable type to that which is operatively connected in highway signage 28. Power test sensor 22*k* may, if desired, be connected in series or connected in parallel with storage battery 26. Sensor 22*k* monitors in real time the power being consumed by highway signage 28. Power test sensor 2*k*'s visible light emitter transmits the current passing through it to a monitoring device that transforms that current into readable data by microprocessor 22*a*. Microprocessor 22*a* receives and processes that data and uses it in conjunction with other data to provide a correct modulated signal 14 for highway signage 28.

Examples of the components of interactive controller 22 would be microprocessor module 22*a* part number MC68HC16. That particular microprocessor module contains memory module 22*b*, an analog to digital converter module 22*c*, an input/output buffer module 22*e*, a battery voltage sensor 22*j*, and a pulse width modulator 22*g*. Interactive controller 22 further comprising an over power shut down module 22*h* part numbers 74121 and 7400, a power test sensor 22*k* part number LM 35, and an ambient light sensor 22*f* part number TSL 230. All of the aforementioned components are for illustration only, any comparably well know components known in the art field may be use.

Visible light control 22*l* comprises a bias control device such as a ULN 2003 Darlington transistor. This particular transistor is for illustration only and any transistor that is capable of transforming a signal changing in amplitude, duration, and repetition to a signal for controlling the power provided to highway signage 28 may be used. The bias control device has an input that may, if desired, be in phase or out of phase with a bias control output. An example of visible light control 22*l* may, if desired, be a bias device that is an open collector power transistor. The open collector is the output of control device 22*l* and the base is the input of control device 22*l*. The base of the power transistor is capable of receiving control signals from microprocessor 22*a*. Highway signage 28 is operatively disposed in the power transistor's collector-base circuit and the control signal is applied to the base-emitter circuit of the power transistor. The effect of the bias control device on the visible light provided by highway signage 28 is imperceptible to the viewer. Highway signage 28 receives an average power that is transformed into a constant desired brightness of the visible light emitters. The current through the visible light emitters contained within highway signage 28 is now modulated but the perceptible brightness of the visible light emitters is constant as the input voltage changes.

Power limiting device 22*m* of controller 22 is operatively disposed in the present invention to limit the power consumed by highway signage 28. Power limiting device 22*m* may, if desired, be of a composition to limit the power consumed by highway signage 28. Power limiting device 22*m* will absorb a selected amount of power and then dissipates that power into heat sink or to the free air. Power limiting device 22*m* may, if desired, be connected between storage battery 26 and visible light control 22*l*. Power limiting device 22*m* may as a matter of convenience be connected between visible light control 22*l* and highway signage 28. Power limiting device 22*m*, depending on the requirements of the power management system may, if desired, be removed from the circuit and storage battery 26 connected directly to highway signage 28 thereby applying full power to the visible light emitters under the control of visible light control module 22*l*. This particular arrangement of the present invention would have an operating range of about 9.1 VDC to 9.25 VDC for three LEDs as compared to the range value of about 10.25 VDC to 17.5 VDC if power limiting device 22*m* was connected in series. An example of power limiting device 22*m* would be a solid state current limiter such as a constant current diode or a composition resistor being of a selected type or value to cooperate with the power requirements of the present invention such as a resistor in the range of about 33 Í to 68 Í.

Ambient light sensor 22*f* monitors ambient light and transmits the monitored signals to microprocessor 22*a* for processing. Light sensor 22*f* represents the changing visible light in the surrounding area of highway signage 28. That signal may, if desired, be remotely transmitted to microprocessor 22*a* in the cases where ambient light sensor 22*f* is positioned at a distance from the present invention but still monitors ambient light that effects the power consumption highway signage 28.

Relay 22*n* is connected in series with visible light control 22*l* and over power shut down module 22*h*. Relay 22*n* may, if desired, be a normally open or normally closed type relay. The control action of the relay is supplied by microprocessor 22*a* through over power shut down module 22*h*. Under normal operating conditions this relay is closed providing the connecting link between visible light control 22*l* and the control portion of the present invention. Under power shut down conditions that relay will open and the power to highway signage 28 will be terminated.

Pulse width modulator 22*g* receives control signals either in an analog or digital format representing data from microprocessor 22*a*. Pulse width modulator 22*g* transforms that data into signals that may be in a stream of pulses or be varying with respect to time. amplitude, period, phase, and power. Pulse width modulator 22*g* may, if desired, be of conventional design known in the art field. Pulse width modulator 22*g* output signals are transmitted to visible light control 22*l* for application to highway signage 28. Those signals represent the desired power requirements of highway signage 28 in the form duty cycle 14.

Figure 3:
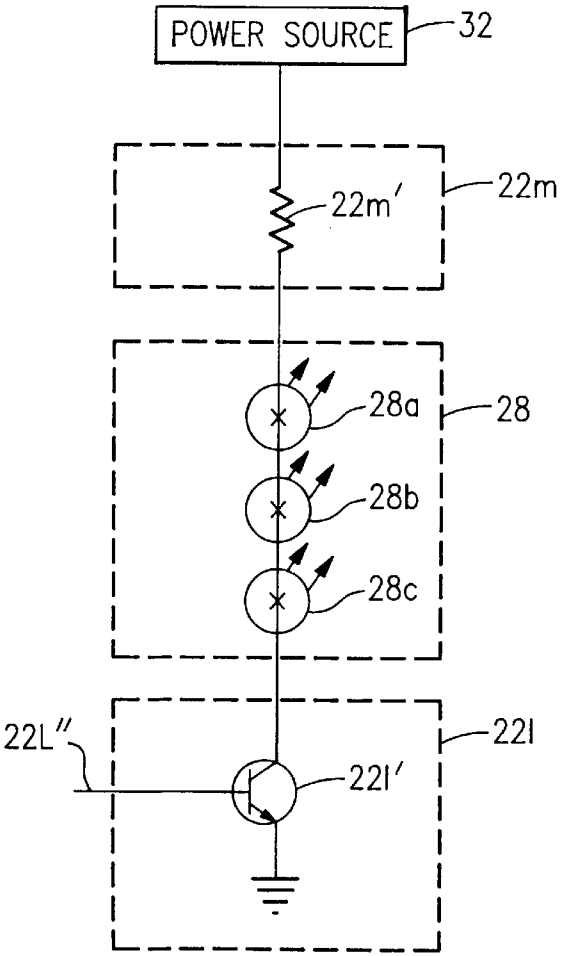
FIG. 3 is a schematic diagram of the visible light control module connected to highway signage.

Duty cycle 14 is the percentage of time current flows through the visible light emitters of highway signage 28 over a specific time period. An example of duty cycle 14: given the voltage drop across serial connected LEDs 28*a*, 28*b*, and 28*c*, FIG. 3, is 2.25 volts per LED and the forward voltage drop of transistor 22*l'*, FIG. 3, is 1.4 volts thereby the total fixed voltage drop is 6.75+1.4=8.15 volts. Also given, power source 32, FIG. 3, is equal to 14.5 volts and resistor 22*m'* is equal to 33 ohms; therefore, the full on current would be (14.5−8.15)^33=192 mA. If the desired average current is 30 mA, then the duty cycle is 30 mA^192 mA=15.6%. Variations of resistor value, power source value, type of visible light emitters used, and bias control devices will not effect the desired constant brightness of the LEDs because as the variables change so does the percentage of duty cycle thereby maintaining a constant desired brightness.

Referring to FIG. 3, illustrating visible light control module 22*l* operatively connected to highway signage 28, highway signage 28 is operatively connected to power limiting device 22*m,* and power limiting device 22*m* is operatively connected to power source 32. Power source 32 may, if desired, be a signal battery or a plurality of batteries connected in series or connected in a parallel arrangement to provide power to highway signage 28. Power source 32 may also be a solar power array comprising a plurality of photovoltaic cells to provide the necessary power for the visible light emitters contained within highway signage 28. Visible light control module 22*l* is illustrated as a single transistor 22*l'* but may, if desired, be a plurality of transistor of any convenient type known in the art field and connected in a multiplicity of arrangements. A typical arrangement is a Darlington coupled circuit to provide the necessary current and control for highway signage 28. An example of this particular transistor is ULN 2003.

Highway signage 28, FIG. 3, may, if desired, be a stationary portable sign comprising an array of any type visible light emitters. Highway signage 28 is illustrated in FIG. 3 as containing only three semiconductor lights emitting diodes (LEDs) 28*a,* 28*b,* and 28*c*. Highway signage 28 may, if desired, comprise a single or a plurality of semiconductor light emitting diodes. Those diodes may be clustered or arranged in series or connected in parallel to form operative cells. The semiconductor light emitting diodes used in power manager 10 are selected for convenience and any type of diodes or incandescent light emitters known in the art may be used such as HLMA-DL00.

Power limiting device module 22*m,* FIG. 3, is illustrated as a resistor 22*m'* operatively connected to power source 32 and highway signage 28. Resistor 22*m'* is illustrated as being connected in series with LEDs 28*a,* 28*b,* 28*c* but resistor 22*m'* may, if desired, be connected in any convenient arrangement to provide operative power limiting. An example of resistor 22*m'* would be a 33 ohm resistor. Power limiting device module 22*m* may, if desired, be a transistor connected in such an arrangement to provide current limiting and power dissipation. Highway signage 28 is connectively disposed in transistor's 22*l'* collector base circuit and receives power from power source 32 under the control of visible light control module 22*l*. Pulse width modulate signal 14 is received by transistor's 22*l'* base emitter circuit 22*l''* thereby LEDs 28*a,* 28*b,* and 28*c* receive a pulse width modulated variable duty cycle that is transformed into constant desired brightness by consuming the average power distributed over the selected LEDs.

Figure 4:
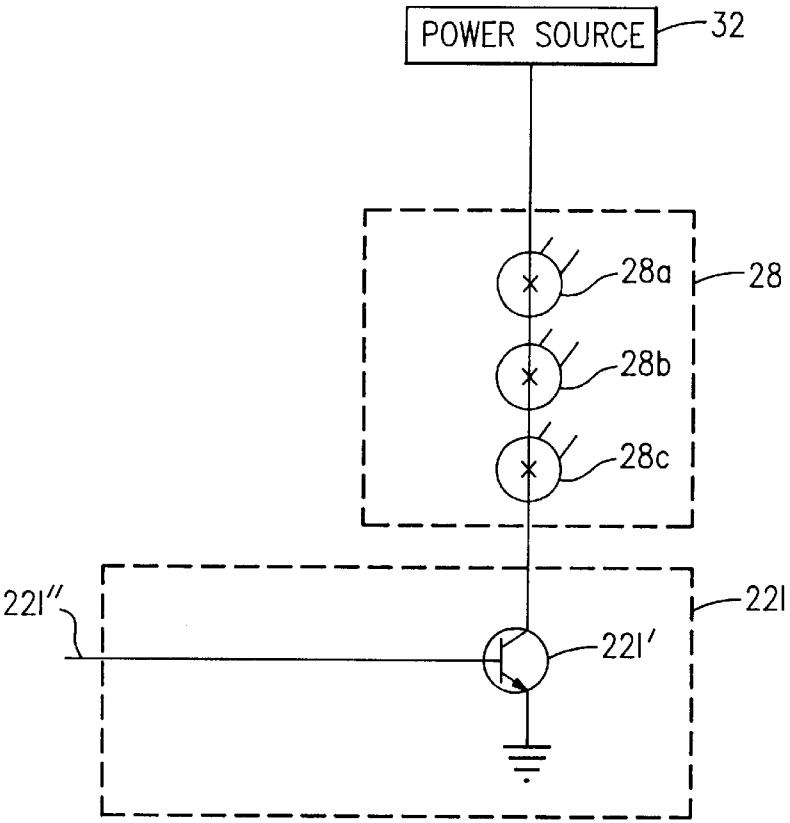
FIG. 4 is an alternate embodiment of FIG. 3.

Referring to FIG. 4, illustrating visible light control module is 22*l* directly connected to highway signage 28. Highway signage 28 is connected directly to power source 32 by a suitable cable. This particular arrangement is an alternate embodiment of power manager 10 and does not require power limiting device module 22*m*. Operatively, both embodiments function approximately the same but power limiting device module 28 may, if desired, be left out of power manager 10 to enhance the economical availability of power manager 10. Power limiting device 22*m* allows for greater reliability.

Figure 5:
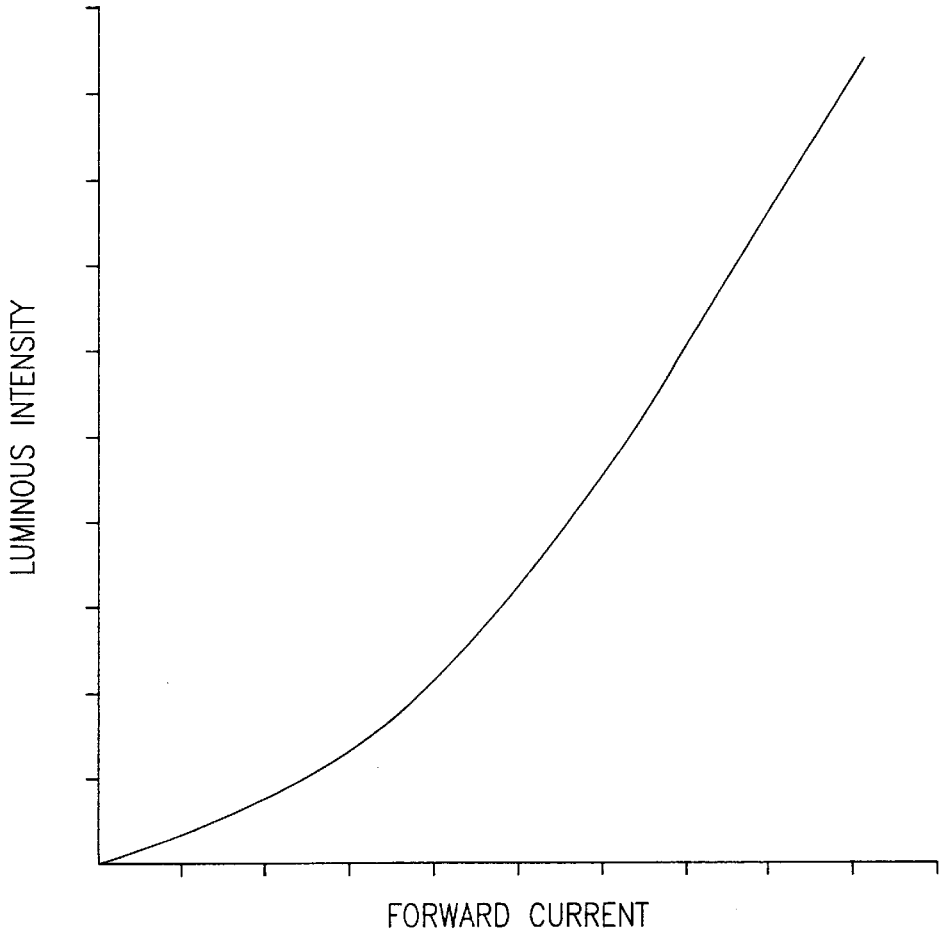
FIG. 5 is a graph of forward current vs. luminous intensity.

Referring to FIG. 5 exponential curve 30 represents forward current vs. luminous intensity. The forward voltage measured across any visible light emitting diode is relatively constant once the diode begins to conduct current. Curve 30 illustrates the effect of increasing the current through the diode, i.e., the luminous intensity will increase exponentially while the voltage measured across the diode will remain relatively constant.

The best mode of operation of the power manager 10 is a method of providing solar array 24, comprising a plurality of photovoltaic cells, operatively connected to rechargeable storage battery 26. Battery 26 is operatively connected to a highway signage 28. Highway signage 28 comprises a of plurality visible light emitting devices all consuming selectable power.

Controller 22 is provided to command and control the operation of the power supplied to visible light emitters contained within highway signage 28. Controller 22 will detect power consumed by the visible light emitting devices and compute the power consumed by those devices. Controller 22 evaluates the computed power by comparing that computed value to a power range that has been predetermined and is stored in controller 22's memory module 22*c*. That stored power range is selectable and is used in computing duty cycle 14. Controller 22 has ambient light sensor 22*f* that monitors the solar light in the vicinity of highway signage 28 to determine the relative brightness of the ambient light. Controller 22 then modulates a control signal comprising duty cycle 14 and applies that modulated control signal to the visible light control module 22*l,* thereby varying the power consumed by the visible light emitters in response to the relative brightness of the ambient light.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A power management system containing a solar power array producing a voltage and transmitting an electric current for a visible light emitting array, comprising:

a voltage monitor operatively connected to said solar power array;

said voltage monitor transmitting operational signals derived from said solar power array;

a controller operatively connected to said voltage monitor, said controller dynamically processing said operational signals, and said controller transmitting dynamic operational commands; and, a current modulator operatively connected to said visible light array and said controller;

said current modulator receiving said dynamic operational commands from said controller;

said current modulator generating a variable power pulse width modulated duty cycle responsive to said dynamic operational commands;

whereby the visible light emitting array receives said modulated current while emitting constant brightness from the visible light emitting array.

2. A power management system as recited in claim 1 wherein said current modulator cooperating with said solar power array whereby the current through said current modulator varies inversely with the voltage monitored over a selected time period.

3. A method for power management, comprising the steps of:

Step 1 providing a photovoltaic solar cell array operatively connected to a rechargeable battery, said battery operatively connected to a semiconductor array of visible light emitting devices consuming selectable power;

Step 2 detecting said power consumed by said visible light emitting devices;

Step 3 computing said power consumed by said visible light emitting devices;

Step 4 evaluating said computed power and said selectable power;

Step 5 monitoring ambient light;

Step 6 determining relative brightness of said ambient light;

Step 7 evaluating said relative brightness;

Step 8 computing a duty cycle from said evaluation steps;

Step 9 modulating a control signal comprising said duty cycle; and

Step 10 applying said modulated signal to a visible control module thereby varying the power consumed by said light array in response to said relative brightness of said ambient light and said detected power.

4. A method for power management as recited in claim 3 wherein said modulating step comprises a varying duty cycle.

5. A power management system for a visible light emitting array operatively connected to a power source comprising:

a visible light control operatively connected to the visible light emitting array;

a controller having operatively disposed within a microprocessor, a memory receiving a predetermined program, a plurality of analog to digital converters and a plurality of bi-directional buffers;

a power consumption sensor operatively connected to said analog to digital converters for providing power consummation data to said controller;

a battery voltage sensor operatively connected to said analog to digital converters thereby said converters providing sensor data to said controller;

an over power shut down control receiving operational data from said controller;

a relay operatively connected to said power shut down control thereby said power shut down control receives operational data from said controller;

an operational signal, computed by said controller, responsive to said power consumption and said battery voltage sensor; and said visible light control receives said operational signal and applies said signal to said visible light emitting array.

* * * * *